US005350337A

United States Patent [19]

Kondo et al.

[11] Patent Number: 5,350,337

[45] Date of Patent: Sep. 27, 1994

[54] ZONE-FORMING APPARATUS

[75] Inventors: Fumio Kondo; Yoshiaki Aoki; Tsuyoshi Imaida, all of Nagoya; Hiroki Nozoe, Nishi; Yuji Maki, Nishi; Shin Watabe, Nishi, all of Japan

[73] Assignee: Mitsubishi Jukogyo Kabushiki Kaisha, Tokyo, Japan

[21] Appl. No.: 965,357

[22] Filed: Oct. 23, 1992

Related U.S. Application Data

[63] Continuation of Ser. No. 569,416, Aug. 17, 1990, abandoned.

[30] Foreign Application Priority Data

| | | | |
|---|---|---|---|
| Aug. 18, 1989 | [JP] | Japan | 1-212643 |
| Aug. 23, 1989 | [JP] | Japan | 1-217125 |
| Feb. 16, 1990 | [JP] | Japan | 2-36800 |

[51] Int. Cl.[5] ..... F24F 3/06; F24F 13/00

[52] U.S. Cl. ..... 454/189; 454/233

[58] Field of Search ..... 454/188, 189, 49, 190, 454/191, 192, 233, 236, 230

[56] References Cited

U.S. PATENT DOCUMENTS

| | | | |
|---|---|---|---|
| 2,210,458 | 8/1940 | Keilholtz | 454/233 |
| 2,817,281 | 12/1957 | Schwan et al. . | |

FOREIGN PATENT DOCUMENTS

| | | | |
|---|---|---|---|
| 229390 | 5/1960 | Australia . | |
| 246184 | 12/1980 | Australia . | |
| 1803740 | 6/1970 | Fed. Rep. of Germany . | |
| 2259670 | 6/1976 | Fed. Rep. of Germany . | |
| 973958 | 2/1951 | France . | |
| 133547 | 10/1981 | Japan . | |
| 48432 | 3/1985 | Japan . | |
| 153638 | 7/1987 | Japan | 454/230 |
| 251740 | 10/1988 | Japan . | |
| 286648 | 11/1988 | Japan | 454/233 |

*Primary Examiner*—Harold Joyce
*Attorney, Agent, or Firm*—McGlew & Tuttle

[57] ABSTRACT

A zone-forming apparatus adapted to direct a jet-stream in a radial direction by a guide member, the jet-stream being emitted from jet-stream generator which is arranged above the apparatus, and an air curtain thus formed is utilized to define a working space.

17 Claims, 11 Drawing Sheets

ZONE-FORMING APPARATUS

This is a continuation application of U.S. Ser. No. 07/569,416, filed Aug. 17, 1990, now abandoned.

FIELD OF THE INVENTION AND RELATED ART STATEMENT

The present invention relates to a zone-forming apparatus which is suitable for forming in the air a zone surrounded by an air-stream.

A radiative dust removal apparatus as shown in FIG. 16 is known from the Japanese Utility Model Application No. SHO62-111700 Publication Official Gazette.

In this radiative dust removal apparatus, air which has been purified in a treatment device 01 is forced by an air fan 02 to flow through a path 06 defined between the outer tube 04 and the inner tube 05 of the dual duct 03 and is supplied into the central portion of the canopy-like hood 07. The air is radially diffused while it flows through an internal fluid path 013 and is blown-out downwardly through an air blown-out port 08 in an outer circumference and thereby forming an air curtain 09.

A local working space 011 is thus formed in a chamber 010, which is surrounded by the air curtain 09 and contaminated air in the working space 011 is withdrawn through an air receiving inlet 012 which opens downwardly to the central undersurface of the canopy-like hood 07 into the inner tube 05 for transfer into the treatment apparatus in which the air is subsequently separated into contaminated solids and purified air.

In the above-described traditional apparatus, the air is blown out downwardly in a film-like configuration through the air blown-out port 08 defined in the outer circumference of the canopy-like hood 07, and since the volume of air to be blown out through the air blow-out port 08 is equal to that of the contaminated air to be withdrawn through the air receiving inlet 012, a short-circuit in a flow occurs easily between the outlet air stream and the inlet air stream.

Consequently, it is not only difficult to form a local working space 011 surrounded by the air curtain 09, but also the canopy-like hood 07 must be enlarged in diameter in order to enlarge this local working space 011, and thereby significantly increasing the flow velocity of the film-like air stream which is blown-out through the air blown-out port 08. Furthermore, such arrangement results in a canopy-like hood 07 with a complicated structure, and the need of double-duct 03 not only incurrs added costs, but also entails cumbersome handling and installing works.

A portable type air conditioner, i.e., a so-called spot cooler has been suggested in the prior art for the Purpose of cooling a limited local space in the air. This spot cooler, however, is designed to blow out a cooling directly against humans and objects, and can serve for only a very limited space, and besides humans feel uncomfortable for a cooling air passing around them at a high-velocity.

OBJECT AND SUMMARY OF THE INVENTION

The present invention has been made in order to solve the above-described problems, and its purport resides in a zone-forming apparatus. The apparatus comprises a jet-stream generating means for generating a fluid jet, and a guide member having a canopy-like guide surface adated to diffuse a jet-stream which has been emitted from this jet-stream generating means to flow along the central portion toward an outer circumference. A zone is formed in the webside space of the above guide member with. The zone being surrounded by a jet-like fluid stream flowing out from the entire outer circumference of the guide member in the direction of the web, i.e., the radial direction of the guide member.

According to the present invention, a jet-stream which has been emitted from the jet stream generating means is diffused to flow along the central portion of the guide member toward its outer circumference, while being guided to flow in contact with and along the canopy-like guide surface of the guide member. Thus, the jet stream flows out in a film-like configuration from the entire outer circumference of guide member toward the webside direction, i.e., in a radial direction of the guide member. This film-like fluid flow is attracted toward itself, and thus a zone is formed in a space located at the webside of the guide member and surrounded by the fluid stream.

In the present invention, a jet-stream which has been emitted from the jet stream generating means is diffused to flow along the central portion of the guide member toward its outer circumference, while being guided to flow in contact with and along the canopy-like guide surface of the guide member. Thus, the jet stream flows out in a film-like configuration from the entire outer circumference of guide member toward the webside direction, i.e., in a radial direction of the guide member. This film-like fluid flow is attracted toward itself, and thus a zone is formed in a space located at the webside of the guide member and surrounded by this fluid stream. Thus, though the apparatus can be built to be very inexpensive, the apparatus can serve to form a zone with a diameter larger than that of the guide member in an easy manner.

By utilizing this apparatus, it is made possible to arrange a wall surface on a webside of the guide member with. The wall surface being in opposition with the web with a predetermined spacing maintained relative to the latter.

Thus, a zone of increased diameter can be formed between the guide member and the wall surface, by arranging a wall surface on the webside of the guide member which is in opposition with the web with a predetermined spacing maintained relative to the latter.

The apparatus also permits the jet-stream generating means to be arranged either on the webside or the back side of the guide member. When the jet-stream generating means is provided on the webside of the guide member, a zone with an increased diameter can be formed, which larger than in the case that the jet-stream generating means is provided on a back side of the guide member.

Moreover, the apparatus of the invention can be provided with a diffusion plate therein which covers the canopy-like guide surface.

By arranging such a diffusion plate which covers the canopy-like guide surface, it is possible to make even the thickness of the film-like fluid stream which flows out of the outer circumference of the guide member, and thereby shielding the zone completely from the space.

Furthermore, in the apparatus, it is possible to arrange a diffusion plate which is in opposition with the jet-stream emitted from the jet-stream generating means, and the outer circumference of the diffusion plate is faced toward the canopy-like guide surface of the canopy-like guide member with a spacing maintained relative to the latter.

In this manner, the fluid can be guided to flow the canopy-like guide surface by means of this diffusion plate which is provided to be in opposition with the jet-stream emitted from the jet-stream generating means and having its circumferential portion located so as to face toward the canopy-like guide surface of the guide member with a spacing maintained relative to the latter.

Moreover, the jet-stream generating means of the apparatus may be provided with an axial impeller.

Furthermore, the guide member of the apparatus may allow its canopy-like guide surface to be formed as a rotary surface to be rotatable about the central axis of the guide member.

An alternative embodiment of the present invention has been made in order to solve the above-described problem, and its purport resides in a zone-forming apparatus with the apparatus comprises a guide member having a inclined canopy-like guide surface which is arranged on a fixed surface so as to be in opposition with the fixed surface with a predetermined spacing maintained relative to the latter, the guide surface being inclined from the central portion to extend along the outer circumference toward the fixed surface, a stream generating means for withdrawing a fluid from outside and inside the guide member and emitting the same toward the central portion of the guide surface, and a jet-stream regulating means located in a zone surrounded by a film-like jet-stream which flows out from the outer circumference of the guide member.

According to the present invention, the fluid is withdraw from outside and inside of the guide member and then emitted toward the central portion of the canopy-like guide surface by the jet-stream generating means, and the jet-stream is diffused to flow along the canopy-like guide surface from the central portion toward the outer circumference of the guide surface, so that a zone may be formed between the guide member and the fixed wall and surrounded by a film-like jet-stream which flows out from the outer circumference. The fluid inside the zone is regulated by means of fluid regulating means provided inside the zone.

In this invention, the film-like annular jet-stream forced to flow in a radial direction along the outer circumference toward the fixed wall, and therefore a zone may easily be formed between the guide member and the fixed wall and having dimensions larger than those of the guide member. Because the re-circulation of the fluid takes place within the zone under the forcing action of the film-like annular jet-stream, the fluid in the zone may be regulated efficiently by means of fluid regulating means provided in the zone.

Moreover, the apparatus can permit the guide member and the jet-stream generating means to be integrally formed and still allow them supported or suspended in the air downwardly by means of strut.

The apparatus can allow the jet-stream generating means to be arranged outside the guide member and made freely foldable like a parasole.

The apparatus of the invention may also utilize an air fan as the jet-stream generating means, and can select among an air conditioner, an air purifyer and a dust remover as the fluid regulating means.

In this way, by employing the air fan as the jet-stream generating means and selecting among the air conditioner, air purifyer and the dust remover as the fluid regulating means respectively, it is made possible to condition or purify an air within the zone surrounded by a film-like air stream.

Where the air fan is utilized as the jet-stream generating means, and selection is made among the air conditioner, air purifyer and the dust remover as the fluid regulating means, a zone can be formed in the air which is surrounded by the air curtain, and besides the air within the zone can be conditioned and purified or made dust-free, and therefore a free access by the human to the zone can be established, ensuring a full-field view as well as a quiet and comfortable living space maintained.

In this apparatus, an air conditioner can be used as the fluid regulating means, and its conditioning unit may be arranged outside the zone.

In this apparatus, the conditioning air blow-out port of the air conditioner can be arranged on a circumference of the apparatus.

In this apparatus, a table may be arranged on the upper portion of the air conditioner.

In this apparatus, a zone-forming air conditioning apparatus can be arranged in a plural number and each of its air conditioner may be connected with a single conditioning unit which is installed outside the zone.

An another alternative embodiment of the invention has been made to solve the above-described problem, and its purport resides in the provision of the apparatus, wherein the apparatus comprises a fan unit for withdrawing an air from outside the air zone and forcing the same, an air guide for forming the air zone by blowing out the air which has been supplied from the fan unit arranged in the air above the air zone downwardly in a film-like configuration, the air zone being surrounded by the film-like air stream, and an air conditioning unit for conditioning air within the air zone.

In accordance with the invention, air which has been withdrawn from outside the air zone is forced and then supplied to the air guide from which it is then blown-out in a film-like air stream downwardly. Thus an air zone is formed which is surrounded by the film-like air stream. The air within the air zone is accordingly conditioned by means of air conditioning unit.

According to the present invention, it is an easy and a rapid process to form an air zone which is surrounded by a film-like air stream which has been blown-out from the air guide in a downward direction. The air within the air zone can be efficiently conditioned by means of air conditioning unit. Because no air stream is blown out directly against humans in the air zone, they do not feel uncomfortable they retain a full field view through the film-like air stream, and are constantly ensured a free access to the air zone through the air stream film.

According to this apparatus, the air conditioning unit is arranged upon the fixed surface in the lower portion of the air zone, and the air fan unit is attached to the upper portion of the strut which is upstandably provided on the air conditioning unit. Furthermore, the air fan unit is provided with the air guide.

In this apparatus, the air fan unit and the air guide are arranged in the air zone via a strut by means of the air conditioning unit arranged on the fixed surface in the lower portion in the air zone.

In this apparatus, the air conditioning unit, the air fan unit and the air guide are operatively integrated, and the air fan unit and the air guide can be easily and promptly supported in the air above the air zone via the strut by means of the air conditioning unit.

Additionally, in this apparatus, while the driving source is housed in the air conditioning unit, the strut is made hollow, and the driving source can be connected with the air fan of the air fan unit through a driving haft which passes through the strut.

In this apparatus, the air fan inside the air fan unit is driven by the driving source which is housed in the air conditioning unit through a driving shaft which passes through the hollow shaft.

In this apparatus, the air fan inside the air fan unit is thus driven by the driving source contained in the air conditioning unit, the apparatus can be designed compact with a lower center of gravity.

Arranged inside the heat source side unit are a heat source side air fan for withdrawing air from outside the air zone and a heat source side heat-exchanger adapted to have its heats exchanged with the air supplied by this air fan. Also arranged in the air conditioning unit are a utilization side air fan for withdrawing the air in the air zone, and a utilization side heat-exchanger adapted to have its heats exchanged with the air supplied by this air fan. These utilization and heat source sides heat-exchangers are incorporated into a refrigeration cycle via cooling medium pipes.

In this apparatus, a thermal energy to the air in the air zone which passes through the utilization side heat-exchanger is afforded by the heat which has been taken up by the heat source side heat-exchanger from the air which had been withdrawn by the heat source side fan and flowed passing through the heat source side heat-exchanger outside the zone.

In this apparatus, the heat taken up by the heat source side heat-exchanger from the air outside the zone is afforded to the air which flows through the heat-exchanger by the utilization side heat-exchanger, whereby affecting an efficient cooling performance in the air zone.

The various features of novelty which characterize the invention are pointed out with particularity in the claims annexed to and forming a part of this disclosure. For a better understanding of the invention its operating advantages and specific objects attained by its uses, reference is made to the accompanying drawings and descriptive matter in which preferred embodiments of the invention are illustrated.

DETAILED DESCRIPTION OF PREFERRED EMBODIMENTS

Figure 1:
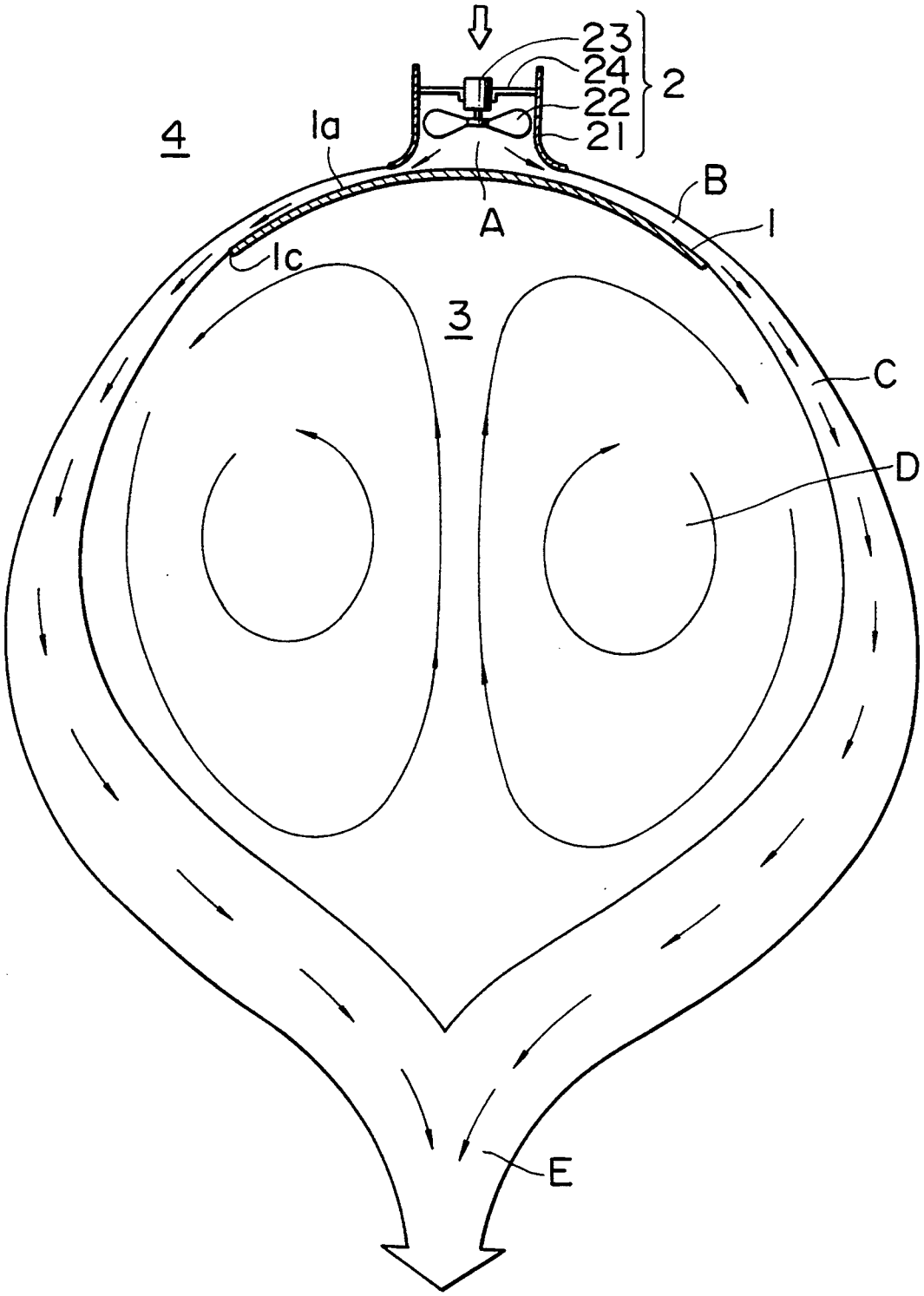
FIG. 1 is a cross-sectional view conceptionally illustrating the first embodiment of the invention.

FIG. 1 illustrates the first embodiment of the invention, wherein there is shown a canopy-type guide member 1 and jet-stream generating means 2 which serve to generate a fluid jet stream. The jet stream generating means 2 is located behind the guide member 1 and comprises a cylindrical casing 21, an impeller 22 provided in and coaxially with the cylindrical casing 21, a motor 23 for driving the impeller 22, and a stay 24 for fixing the motor 22 on the casing 21. The guide member 1 and the jet-generating means 2 are supported in a space 4 by suspending them from a ceiling etc., or alternatively supported by utilizing a strut and other suitable means.

A jet stream A is emitted from the jet-stream generating means 2 and impinges against the central portion of a canopy-like guide surface 1*a* located behind the guide member 1. The jet-stream A is diffused to flow in stream B in contact with the guide surface 1*a* toward a circumferential edge 1*c* from which it then flows out in a film-like annular stream C in an angular lower direction, i.e., toward and in the radial direction of the web of the guide member 1. The annular jet-stream has its diameter enlarged as it flows further, and then has its diameter reduced to merge again into a stream recombination point E. Thus, a local closed space, i.e. a zone 3, is formed in the space 4 zone 3 is surrounded by the stream C, and a recirculating stream D is created in the zone 3.

That is, the pressure in the zone 3 is lower than that in the space 4, because the annular stream C has the property of entrainment, that is, of withdrawing and dragging its surrounding air therealong while it flows. Thus, the stream C attracts itself to bend the stream line of the jet-stream C. The result being that the stream line of the jet-stream C may be determined such that the negative pressure is balanced with centrifugal forces (diffusion forces) which act upon the jet-stream C.

Figure 2:
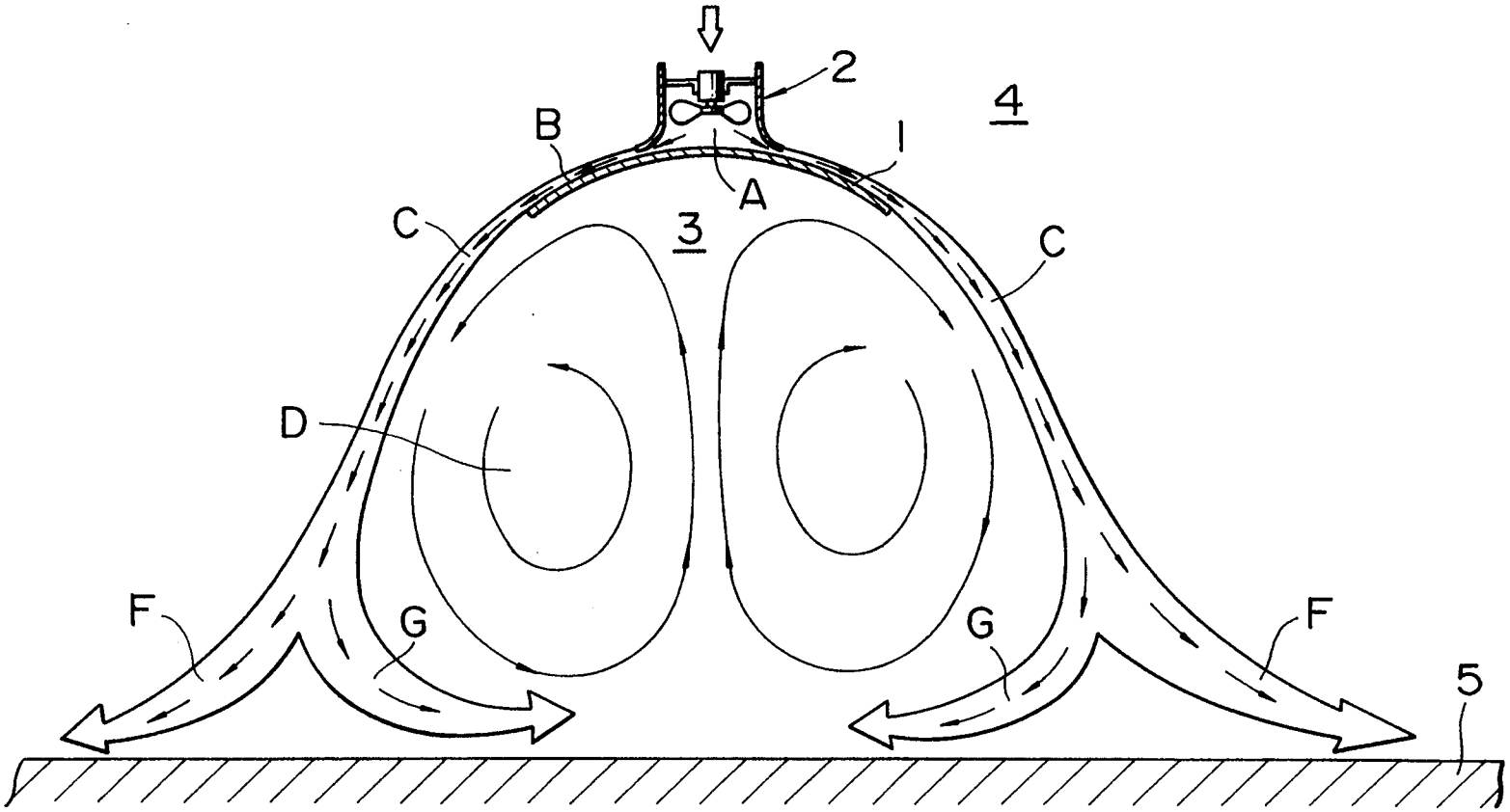
FIG. 2 is a cross-sectional view conceptionally illustrating the second embodiment of the invention.

FIG. 2 illustrates a second embodiment of the invention, wherein a flat surface such as a wall surface 5 of the floor or the ground and the like is arranged at the webside of the guide member such that the surface 5 may be opposed with a predetermined space maintained relative to the web, and thereby forming a zone 5 between the wall surface 3 and the guide member 1. The present embodiment is the same with the first embodiment in other respects.

When the annular jet-stream C impinges against the wall surface 5, it is split into a stream F which is then diffused outwardly to flow along the wall surface 5, and a stream G which then flows inwardly into the zone 3.

The stream G which flows inwardly into the zone 3 acts to reduce a negative pressure in the zone 3, and thereby increasing the dimension of the zone 3 larger than that when the zone 3 is clear of wall surface 5.

Figure 3:
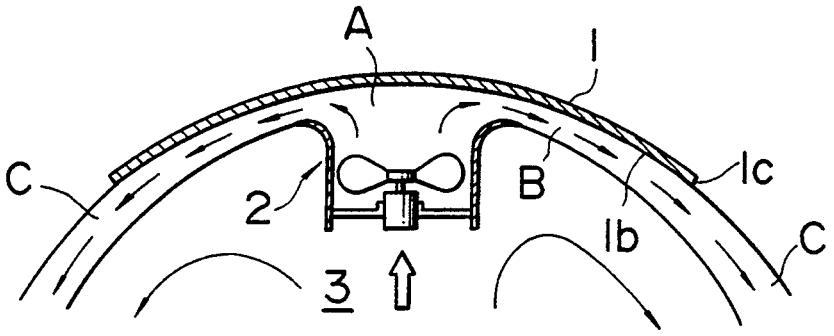
FIG. 3 is a cross-sectional view conceptionally illustrating the third embodiment of the invention wherein the jet-stream generating means and the guide member are disclosed.

FIG. 3 illustrates a third embodiment of the invention, which is of the same arrangement as those in the first and the second embodiments, excepting in that the jet-stream generating means 2 is provided at the webside of the guide member 1.

In this third embodiment, the jet-stream which is emitted from the jet-stream generating means 2 impinges against a central portion of the canopy-like guide surface 1*b* located at the webside of the guide member 1 and then flows along the guide surface 1*b*. The negative pressure in the zone 3 is elevated higher in this embodiment than in the first and second embodiments, because the jet-stream generating means 2 withdraws the air from the interior of the zone 3, and consequently the size of the zone is rendered smaller than in the first and the second embodiments.

Figure 4:
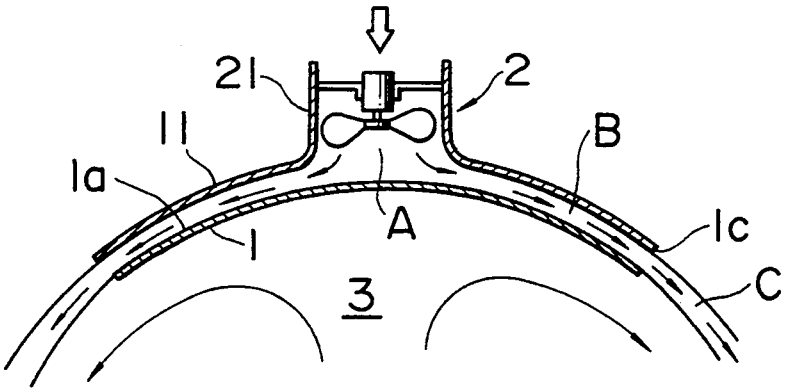
FIG. 4 is a cross-sectional view conceptionally illustrating the fourth embodiment of the invention, wherein the jet-stream generating means, guide member and the cover plate are disclosed.

FIG. 4 illustrates a fourth embodiment of the invention, wherein a cover plate 11 is provided above the canopy-like guide surface 1*a*. The cover plate 11 is behind the guide member 1 with a slight clearance maintained therebetween so as to cover the canopy-like guide surface 1*a*. The inner circumferential edge of the cover plate 11 is jointed with the outlet end of the casing 21 of the jet-stream generating means 2.

In this fourth embodiment, the stream B which flows along the canopy-like guide surface 1*a* is not sensitive to a disturbance, such as for example, a motion of the air inside the space 4, and thereby making it possible to make even the thickness of the film-like jet-stream C which flows out of the outer circumferential edge 1*c*, whereby completely shielding the zone 3 from the space 4.

Figure 5:
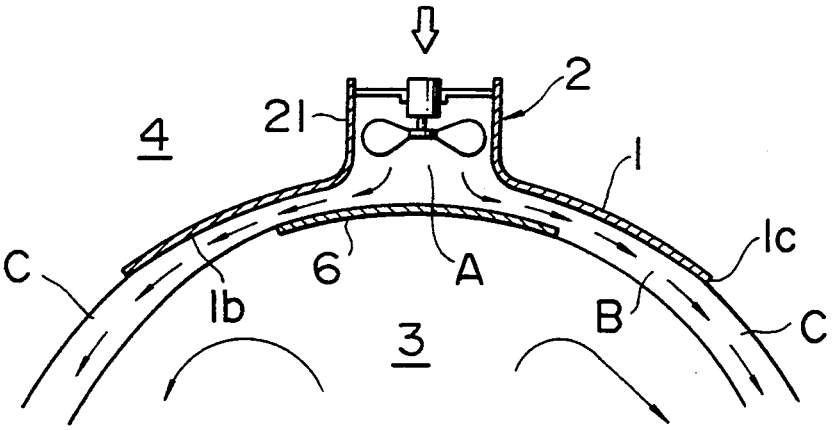
FIG. 5 is a cross-sectional view conceptionally illustrating the fifth embodiment of the invention, wherein the jet-stream generating means, guide member and the diffusion plate are disclosed.

FIG. 5 illustrates a fifth embodiment of the invention, wherein a diffusion plate 6 is arranged precisely oppose with the jet-stream A which is emitted from the jet-stream generating means 2, the diffusion plate 6 having its circumferential portion faced toward the canopy-like guide surface 1*b* located at the webside of the guide member 1 with a slight clearance maintained therebetween. The guide member 1 has its inner circumferential edge jointed with the outlet and of the casing 21.

In this fifth embodiment, the jet-stream A which emitted from the jet-stream generating means 2 impinges against the diffusion plate 6 and then is diffussed. The diffused stream is guided by the diffusion plate 6 to flow along the canopy-like guide surface 1*b* located at the web side of the guide member The fifth embodiment is less sensitive to disturbance, and because the jet-stream generating means 2 withdraws the air from the space 4, the zone 3 is not small in dimensions.

Figure 6:
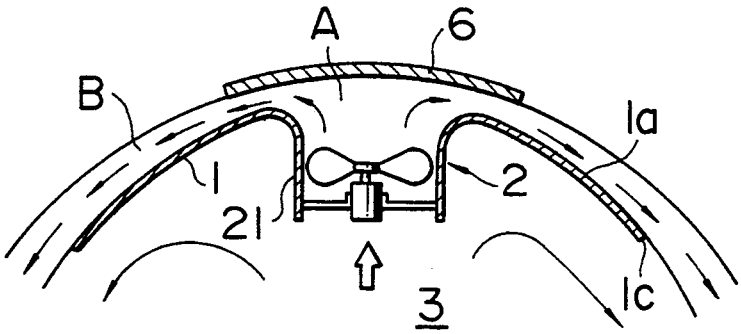
FIG. 6 is a cross-sectional view conceptionally illustrating the sixth embodiment of the invention, wherein the jet-stream generating means, guide member and the diffusion plate are disclosed.

FIG. 6 illustrates a sixth embodiment of the invention, which is the same with the fifth embodiment, expecting in that the yet-stream generating means 2 arranged at the webside of the guide member 1 so that an air stream may flow along the canopy-like guide surface 1*a*.

Figure 7:
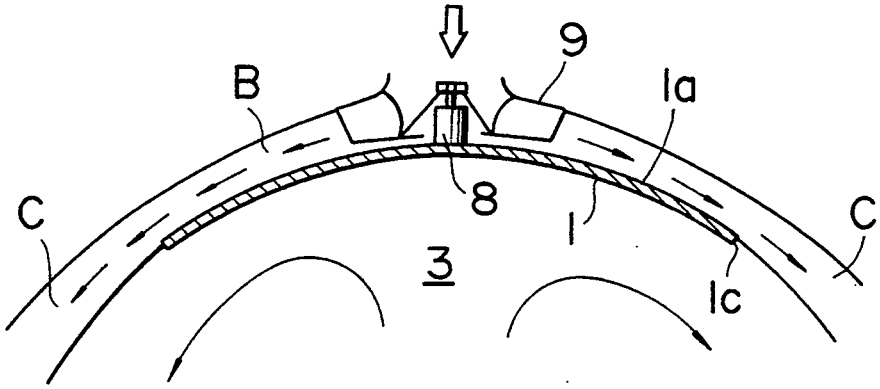
FIG. 7 is a cross-sectional view conceptionally illustrating the seventh embodiment of the invention, wherein the impeller and the guide member are disclosed.

FIG. 7 illustrates a seventh embodiment of the invention, wherein the jet-stream generating means comprises an axial impeller 9 driven by a motor 8.

In this seventh embodiment, an air stream which flows out from the axial impeller 9 flows along the canopy-like guide surface 1*a* located behind the guide member 1.

Figure 8:
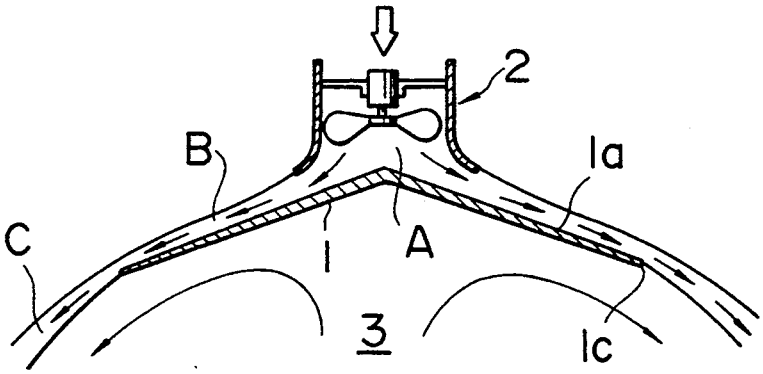
FIG. 8 is a cross-sectional view conceptionally illustrating the eighth embodiment of the invention, wherein the jet-stream generating means and the guide member are disclosed.

FIG. 8 illustrates an eighth embodiment of the invention, wherein the canopy-like guide surface 1*a* is located behind the guide member 1 and formed to provide a conical surface. The configuration of the guide surface 1*a* affects the diameter of the zone 3 and a position where the jet stream C merges with itself, but any conical, spherical and a hyperbolic curved surface etc., may be used as long as it is defined as a rotary surface rotatable about the central axis of the guide member 1.

The present invention has thus been described as the formation of zone which is surrounded by air stream in ambient air, but an air is not a sole zone-forming medium, and such zone may naturally be formed in any gas, and fluid etc., by emitting it as a jet-stream.

Figure 9:
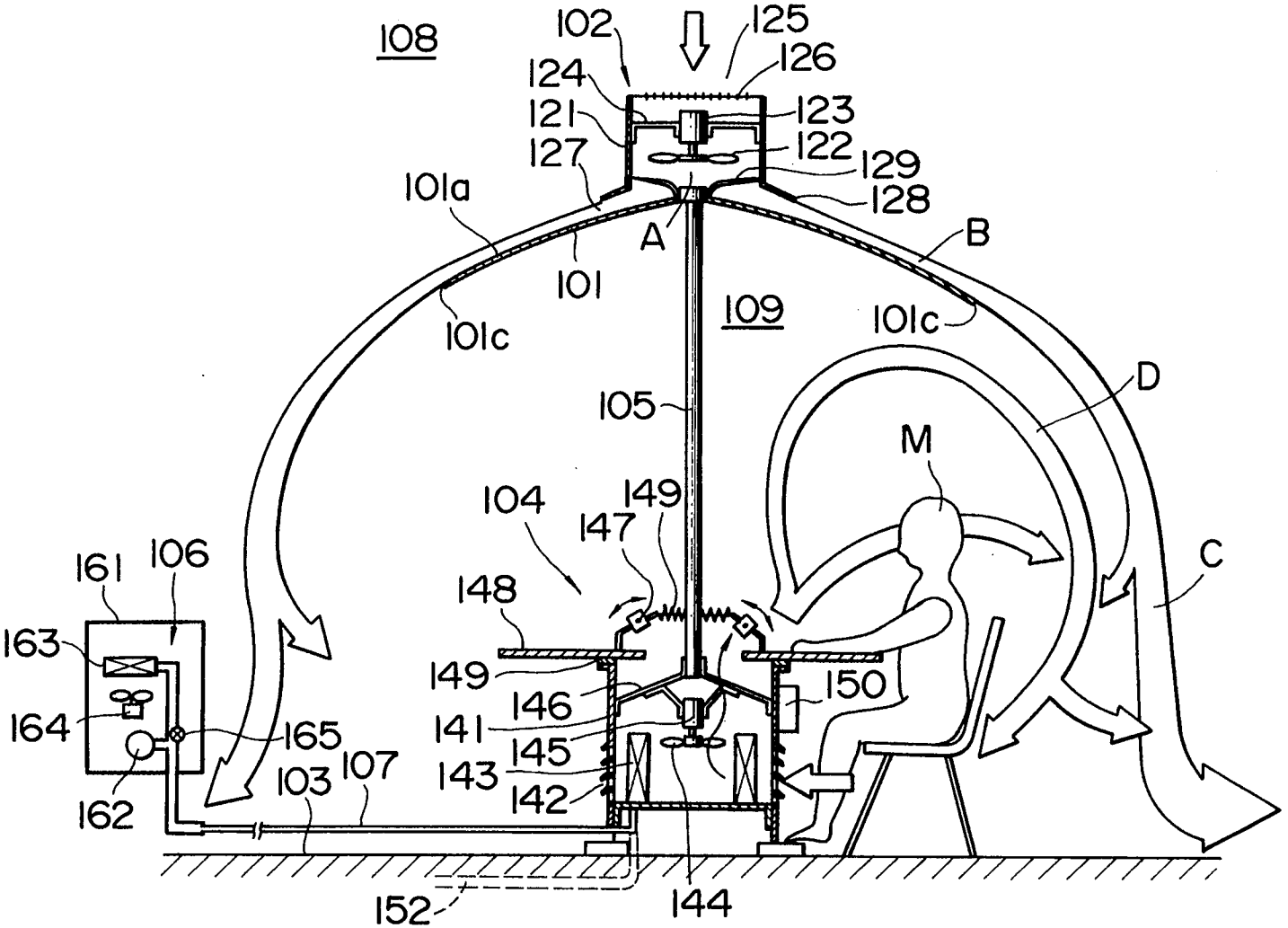
FIG. 9 is a cross-sectional view conceptionally illustrating the ninth embodiment of the invention.

FIG. 9 illustrates a ninth embodiment of the invention, wherein there are arranged a guide member 101, a jet-stream generating means comprised of an axial flow fan 102, a fixed wall 103 such as a ground or floor surface, and a fluid regulating means 104 comprised of an air conditioner.

The guide member 101 has a canopy-like inner surface 101*a* which extends radially with a downward inclination along its central portion to its outer circumferential edge.

The axial flow fan 102 comprises a cylindrical casing 121, an impeller 122 axially arranged inside the casing 121, a motor 123 for driving the impeller 122, a stay 124 for driving the motor 123 on the casing 121, a guard 126 attached at an air inlet port 125, and a guide 128 attached to the an air outlet port 127 and jointed to the upper central portion of the guide member 101 by means of bracket 129.

Arranged in the housing 141 of the air conditioner 104 is a heat exchanger 143 which is located so as to oppose against an air inlet grill 142. A fan 144 mounted at the central portion of the heat-exchanger 143 is driven by a motor 145 which is supported in place by a support plate 146. A plurality of conditioning air blow-out ports 147 is arranged around the circumference of the top of the housing 141, and these blow-out ports 147 are made free to vary their inclination angle.

Mounted on the housing 141 via a vibration-damping material 149 is a table 148, and the housing 141 provided at its side below the table 348 with a control panel 150.

A strut 105 passes sealingly through a bellows provided centrally at the top of the housing 147. The strut 105 has its lower end supported on the support plate 146, and a guide member 101 and a jet-stream generating means 102 mounted on its upper end. An electric wire and the like may be arranged in the strut 705, if the strut 105 is made hollow.

A condensing unit 106 is connected with the air conditioner 104 via a cooling medium pipe 107. The condensing unit 106 is provided with a compressor 162, a heat-exchanger 163, a fan 164 for supplying air to heat-exchanger 163 and an orifice 165 etc., which are included in the housing 161.

Thus, the guide member 101 is supported in the space 108 by means of strut 105 with a predetermined space maintained relative to the fixed wall 103 such that the guide member 101 may oppose the fixed wall 103. An axial flow fan 102 is integrated with and supported on the upper exterior of the guide member 101 by means of strut 105. The air conditioner 104, to be described later, is arranged in zone 109 and on the fixed wall 103 below the lower portion of the guide member 101. The condensing unit 106 is arranged outside the zone 309.

Thus, the motor 123 is actuated to drive the impeller 122 to rotate, when the axial flow fan 102 is operated through the control panel 150.

Then, air is admitted to flow from outside the guide member 101 into the casing 121 passing through a guard 126 and an air inlet port 125. The air then is forced by means of the impeller 122 to be emitted in the form jet-stream A toward the canopy-like guide surface 101*a* the guide member 101. The jet-stream impinges against the central portion of the canopy-like guide surface 101*a*, and is diffused into a stream B to be guided by the guide along the guide surface 101*a* a to flow in the direction of outer circumference 101*c*. Subsequently, the air jet-stream B flows out in the configuration of the film-like annular jet-stream C in a downward angular direction from the entire outer circumference 101*c*. The jet-stream C progressively varies its flow direction downwardly as it further flows, and then impinges against the fixed wall 103, from where it then flows in the direction outside the zone 109 along the fixed wall 103.

As a result, this annular jet-stream C serves to create an air curtain which extends from the outer circumference 101*c* of the guide member 101 to the fixed wall 103. This air curtain then produces a local enclosure space, i.e., a zone 109 within a space 108 between the guide member 101 and the space 108. The zone 109 being surrounded by the air curtain.

Because the annular jet-stream C has the property of withdrawing a surrounding air to drag therealong, the pressure prevailing in the zone 109 is reduced to be lower than that in the space 108. As a recirculating stream D is generated in the zone 109, the stream line of the jet-stream C is bent due to the mutual attracting action of the annular jet-streams C itself. Consequently, the stream line of the jet-stream C is determined such that the negative pressure and axial forces acting upon the jet-stream C may be balanced.

On the other hand, when the air conditioner 104 and the conditioning unit 106 are operated in a cooling mode through the control panel 150, a cooling medium which is delivered from the compressor 162 of the conditioning unit 106 enters a heat-exchanger 163 where the cooling medium has its heats exchanged with an air supplied from a fan 64, and is caused to condense and then subject to adiabatic expansion by means of an orifice 165. The cooling medium, passing through a cooling pipe 107, then enters into the heat-exchanger 143 of the air conditioner 104 in which it is evaporated, and then returns back to the condensing unit 106, again flowing through the cooling medium pipe 103, and is withdrawn into a compressor Simultaneously, the air fan 144 of the air conditioner is driven to rotate, and consequently an air in the zone 109 enters into the housing 141, flowing through an air inlet grill 142, and is cooled while passing through the heat-exchanger 143. Then, the cooled air is forced by an air fan 144 to blow out from a plurality of controlling air blow-out ports 147 into the zone 109. The air recirculated within the zone and, partially entrapped into the jet-stream C, while at the same time preventing the stream C from being diffused into the space 108. Fluid which is condensed upon the surface of the heat-exchanger 143 while the air conditioner 104 is run in a cooling mode are removed through a drain hose 752. The pressure in the zone 709 is lowered while the air conditioner 704 is being run on a cooling mode, because the air has a relatively small volume in the zone, and consequently the zone 109 may easily be formed by the jet-stream C, and thereby permitting the zone 109 to be cooled.

Upon the air conditioner 104 being operated on a heating mode, the cooling medium is circulated in a direction opposite to that flowing on a cooling mode, and the air fan 144 of the air conditioner 104 is driven to rotate in a reverse direction, whereby withdrawing the zone air into the housing 141 through controlling air blow-out ports 147, and after being forced by the air fan 144, it is heated while passing through the heat-exchanger 143, and subsequently is blown out into the zone 109 through the air inlet grill 142. In this way, it is possible for a person M in the zone 109 to be warmed with its head cool and its feet warm. In the meantime, the air fan 144 may be rotated during on the heating mode in the same direction as that on the cooling mode. Contaminants and odor of the air in the zone 109 can be removed by installing a dust filter or a deodorizing filter in the air path in the housing 141 of the air conditioner 104.

Because the zone 109 is partitioned by the air curtain C, and the ingress of the noise into the space 108 may be prevented, while ensuring an efficient air conditioning and purifying effect for the zone 109, and thereby allowing the air conditioner 104 to reduce its expenditures for maintenance and running operation.

Besides, as the zone 109 is merely partitioned by the space 108 and the air curtain C, a person M in the zone can retain a full-field view through the air curtain C, and also maintain a free access to the zone through the curtain C.

Figure 10:
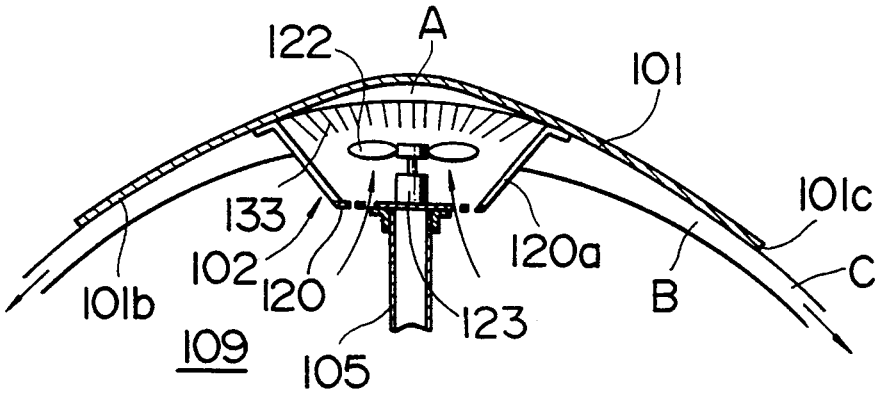
FIG. 10 is a cross-sectional view conceptionally illustrating the tenth embodiment of the invention, wherein the jet-stream generating means and the guide member are disclosed.

Although the jet-stream generating means 102 is arranged outside the upper portion of the guide member in the FIG. 9 embodiment, it may be arranged inside the lower portion of the guide member 701, that is, the means 102 may be arranged in the zone 109 as shown in FIG. 10. The jet-stream generating means 102 is fixed upon the top of the strut 105 via a supporting device 120, and the guide member 101 is secured on the supporting device 120 by means of stay 120*a*.

Upon the motor 723 being driven, the impeller 122 is rotated to withdraw and force the zone air, and then emit it toward the central portion of the canopy-like guide surface 101*b* inside the guide member 101. The air stream A which is thus emitted impinges against the guide surface 101*b* and is diffused into a stream B which then flows along the guide surface 101*b* passing through the metal screen 133.

Figure 11:
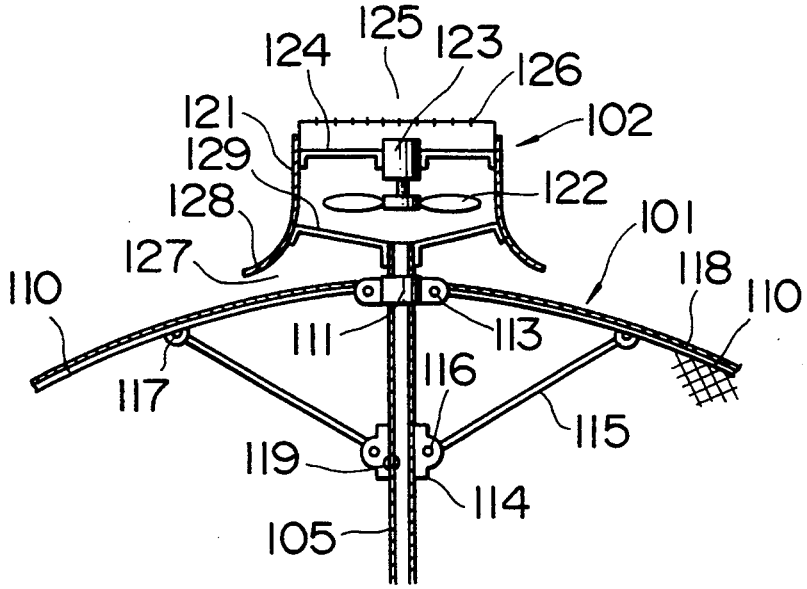
FIG. 11 is a cross-sectional view conceptionally illustrating the eleventh embodiment of the invention, wherein the jet-stream generating means and a foldable type guide member are disclosed.

The guide member 101 may be of a freely foldable type like a parasol, as shown in FIG. 11.

A plurality of main ribs 110 is freely pivotably journalled on a piece 111 via a pin 113, the piece 111 being secured at its proximal end in position on the upper portion of the stay 105. A plurality of sub-ribs 115 has one end pivoted via a pin 116 on a slider 114 which engages the strut 105 for up-and-down movement, the opposite end of these sub-ribs 115 is pivoted via a pin 117 on each of main ribs 110. A flexible membrane 118 made of a cloth and synthetic resins etc., is laid over the main ribs 110.

The slider 114 is adapted to be latched at a predetermined height of the strut 105 by means of an engagement piece 119.

In an adverse weather condition such as a heavy wind, the latch may be released from engagement with the latching piece 119 to move the slider 114 downwardly, and thereby causing the main rib 110 to pivot about the pin 113 to fold the flexible membrane 138.

Figure 12:
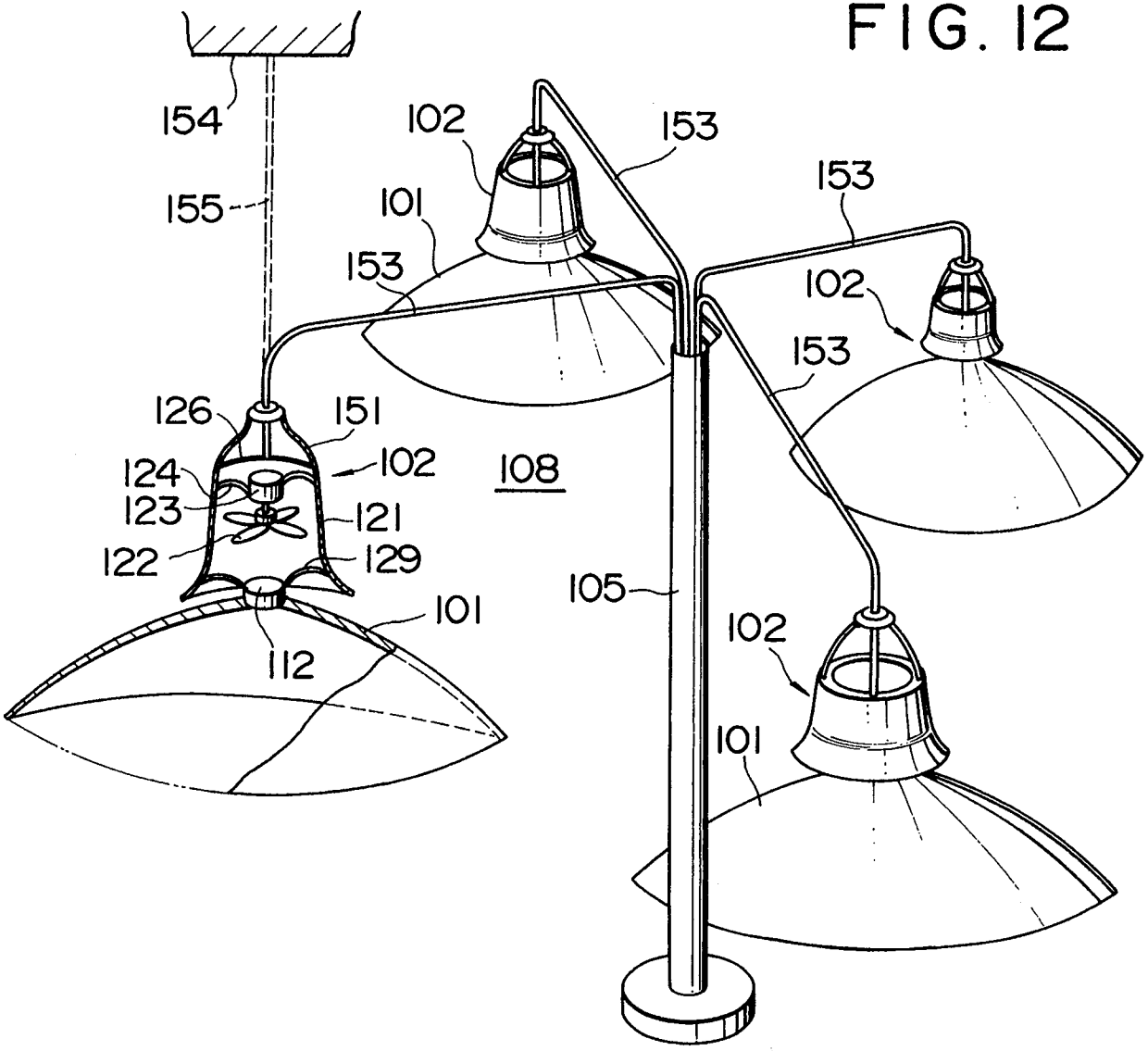
FIG. 12 is a perspective view partly in section conceptionally illustrating the twelfth embodiment of the invention.

FIG. 12 illustrates a twelfth embodiment of the invention, wherein the guide member 101 and jet-stream generating means are integrated and suspended in the space 108. By jointing the bracket 129 of the jet-stream generating means with a boss 112 formed on the upper surface of the central portion of the guide member the jet-stream generating means 102 is fixed on and integrated with exterior side of the upper portion of the guide member 101. The upper portion of the jet-stream generating means is provided with a stay 151 which is turn attached to the lower end of a rod 153 which branches off from the upper end of the center pole 105. Meanwhile, the stay 151 may also alternatively be attached to the lower end of a rod or wire 155 depended from the ceiling 154 of the building. It is also available to suspend a plurality of guide members 101 and the jet-stream generating means 102 in the air utilizing a single center pole 105, as shown. In this case, a plurality of air conditioners 104 to be arranged in the zone 109 which is defined in the lower direction of each guide member 101 can be connected with a single conditioning unit via a cooling medium pipe.

Figure 13:
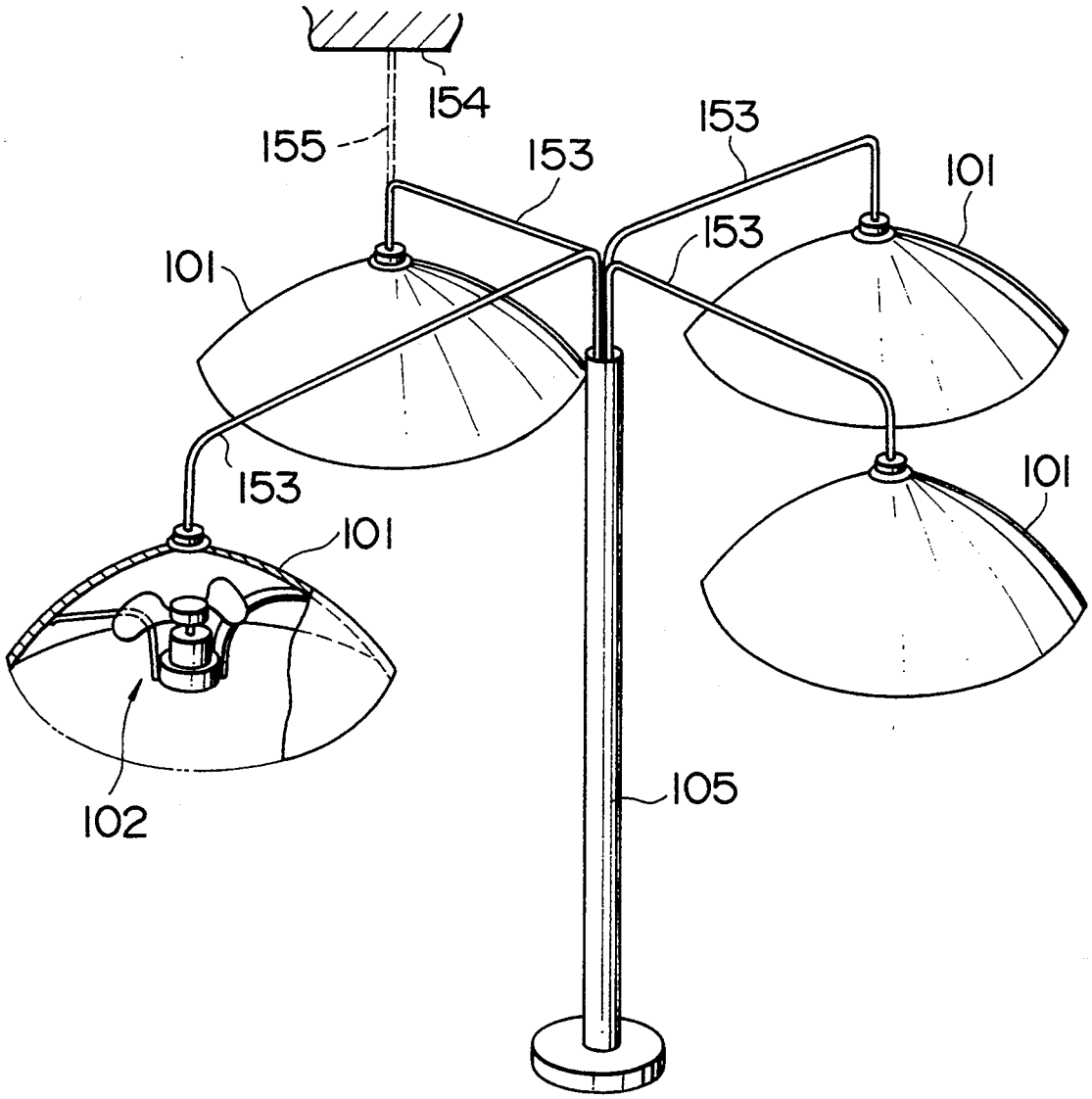
FIG. 13 is a perspective view partly in section conceptionally illustrating the thirteenth embodiment of the invention.

Alternatively, the jet-stream generating means 102 may be arranged inside the lower portion of the guide member 101 and a plurality of guide members 101 may be suspended in the air utilizing a single center pole 105, as shown in the thirteenth embodiment of FIG. 13.

Figure 14:
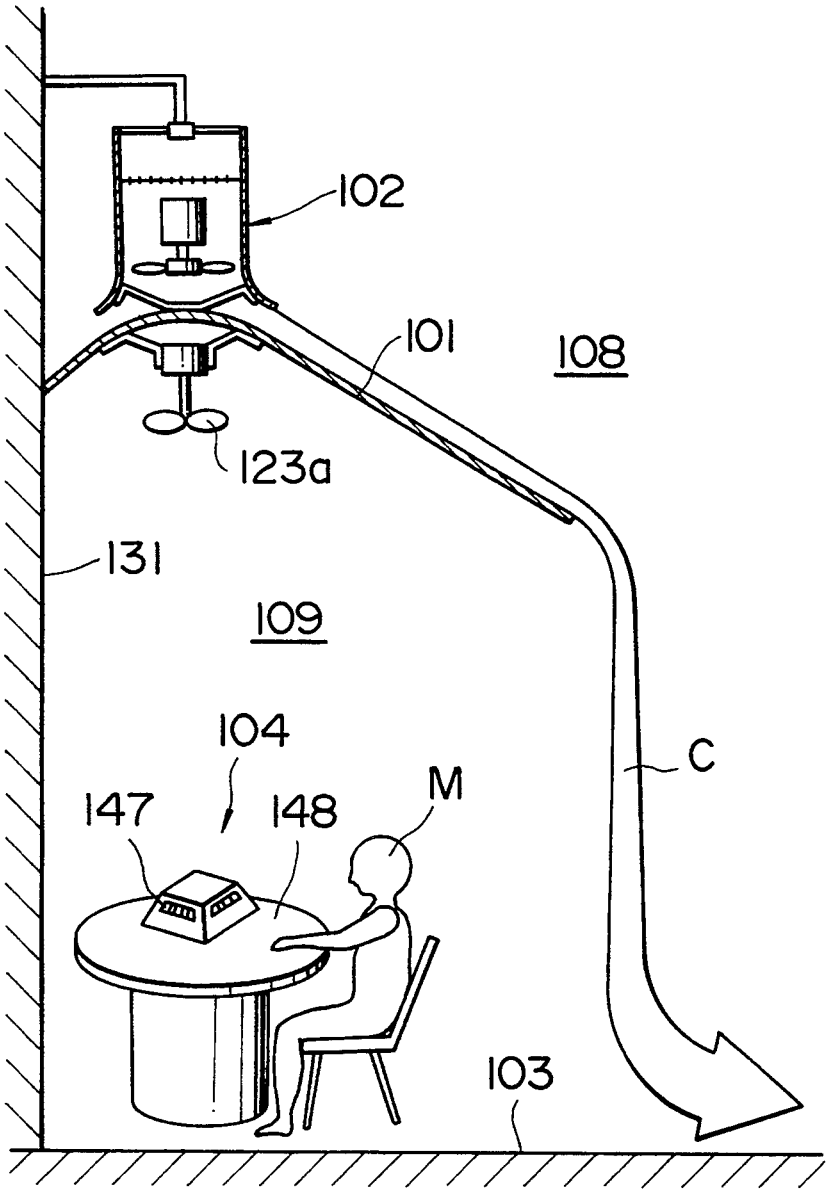
FIG. 14 a cross-sectional view conceptionally is illustrating the fourteenth embodiment of the invention.

As shown in the fourteenth embodiment of FIG. 14, the guide member 101 can be suspended in the air adjacent to a vertical wall 131. In this case, the guide member 101 is partially notched to come into a close contact with a vertical wall 131. Meanwhile, the formation of the zone 109 can be facilitated and the air stirring effect in the zone 109 can be improved, by arranging a booster fan 123*a* inside the guide member 101.

The present invention has been described hereinbefore as to the formation of the zone in the air which is surrounded by an air stream, but an air is not a sole medium and any fluid such as a gas and a liquid etc., may naturally be used to form a zone therein which is surrounded by the jet-stream of the fluid itself utilized.

Figure 15:
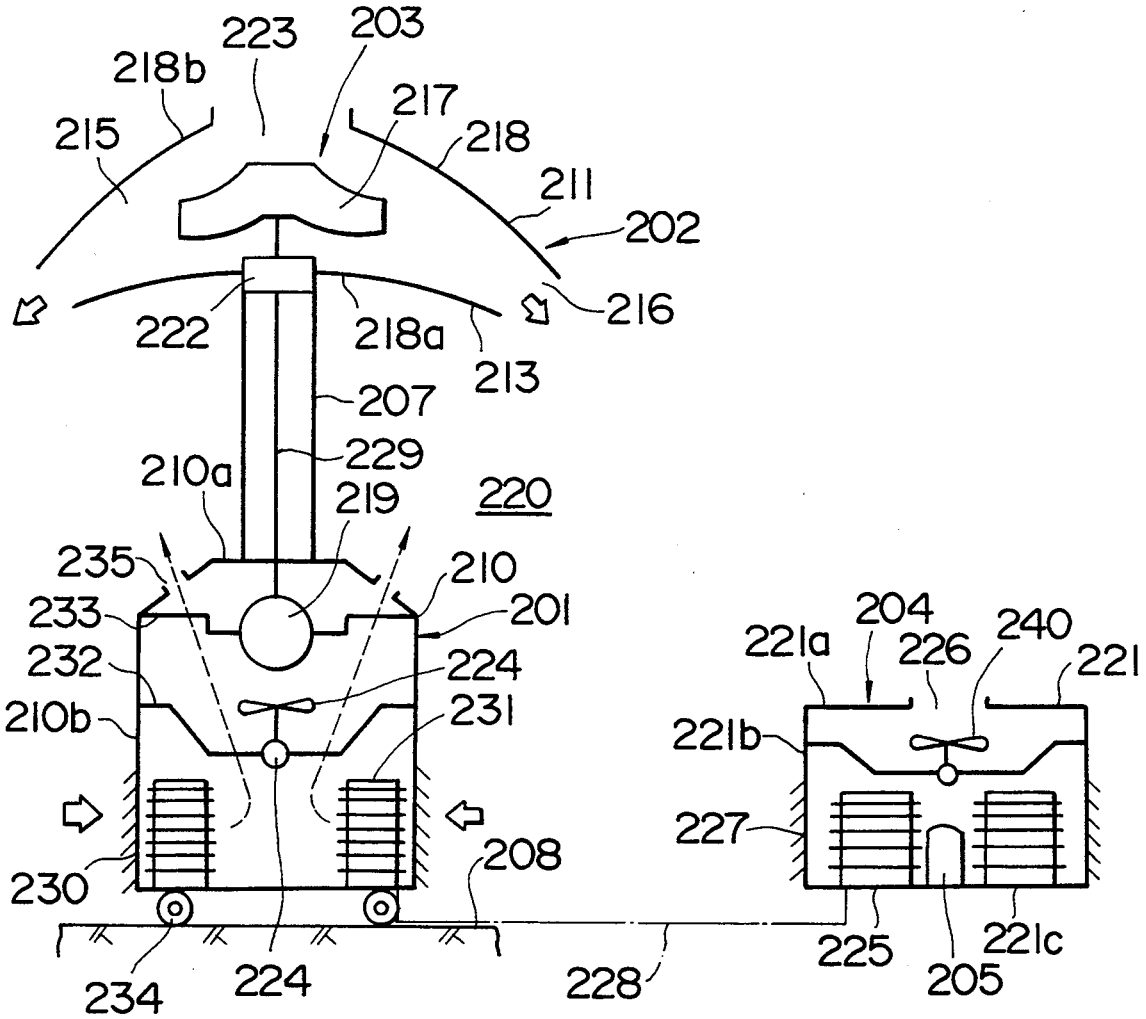
FIG. 15 is a cross-sectional view conceptionally illustrating the fifteenth embodiment of the invention.
Figure 16:
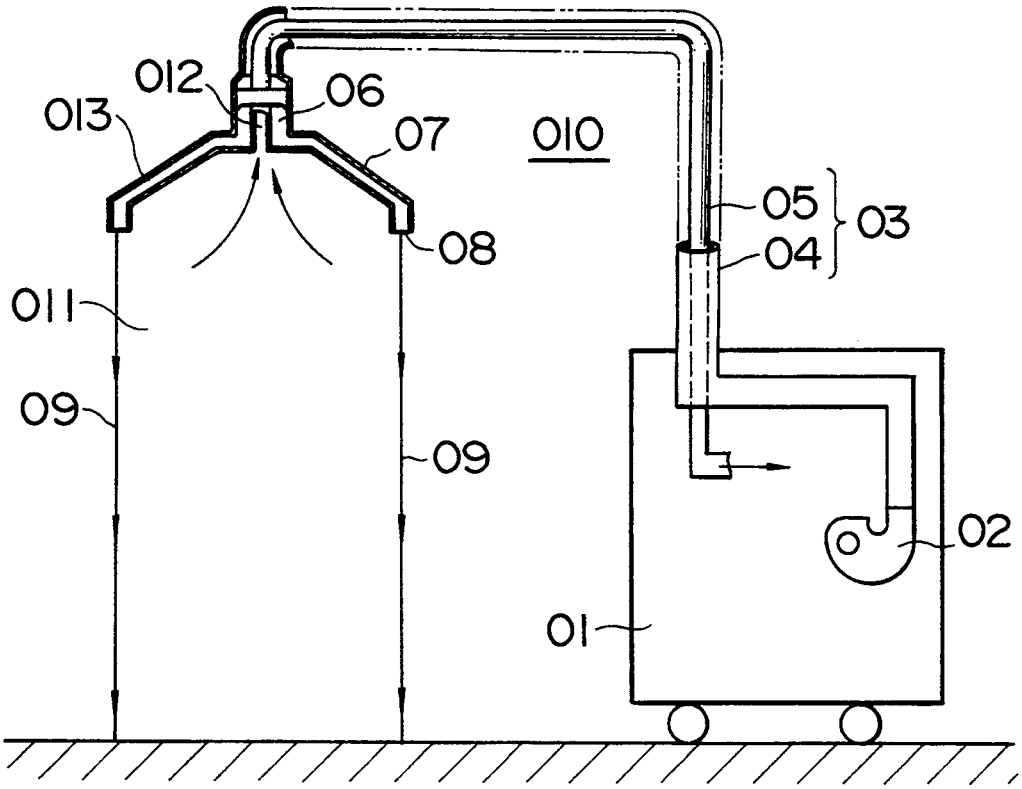
FIG. 16 PRIOR ART
FIG. 16 is a cross-sectional view conceptionally illustrating by way of example a prior art apparatus.

FIG. 15 illustrates a fifteenth embodiment of the invention, wherein there are arranged an air conditioning unit 201, an air guide 202, an air fan 203 and a heat source unit 204.

Arranged at the lower portion of the cylindrical machine box 210 of the air conditioning unit 201 is an annular utilization side heat-exchanger 231 which is arranged to oppose against an inlet port 230 defined through a circumferential wall 210*b*. The utilization side heat-exchanger 231 is provided at its central portion with utilization side air fan 224 which is attached via a stay 232 to a machine box 210. A driving source 219 such as a motor and the like is attached to the machine box 210 via a stay 233 above the utilization side air fan 224. A caster 234 is attached to the under surface of the machine box 210, and the air conditioning unit 201 is adapted to be moved easily by actuating the caster 234 to roll over a fixed surface such as a ground below the air zone 220, and a fixed surface 208 like a floor surface etc., Moreover, the top plate 210*a* of the machine box 210 has a plurality of controlling air blow-out ports 235 defined through the circumference thereof. The top plate 230*a* is provided at its central portion with a hollow strut 207 which stands uprightly.

The upper portion of the strut 207 is provided with an air fan unit 203 which has a casing 218 with an air fan 217 enclosed therein. The air fan 217 is driven by means of a driving source 219 via a driving shaft 229 which extends upwardly passing through a hollow strut 207 and a bearing 222 fixed on the bottom plate 218*a* of the casing 218. A fresh air inlet port 223 is defined centrally through the top plate 218*b* of the casing 218.

The air guide 202 consists of a cup-like upper guide 211 and a cup-like lower guide 213 which is arranged below the upper guide 211 with a spacing maintained relative to the latter. These upper and lower guides 211 and 213 have their respective proximal ends integrally jointed with the top and the bottom plates 218*b* and 218*a* of the casing 218 of the air fan unit 203, and these guides are designed to approach progressively closer toward each other as they extend further toward the tip end, and be curved progressively in a downward direction.

The heat source 204 is arranged outside the air zone 220 with the machine box 221 enclosing the compressor 205, heat source side air fan 240 and the heat side heat-exchanger 225 therein. The compressor 205 is centrally arranged on the base plate 221*c* of the machine box 221, and the heat source side air fan 240 is centrally arranged on the upper portion of the machine box 221 so as to face with an exhaust outlet port 226 centrally defined through the top plate 221*a* of the machine box 221 of the heat source air fan 240. The heat source side heat-exchanger 225 is arranged to oppose against a fresh air inlet port 227 defined through the circumferential wall 227*b* of the machine box 221.

Jointed each other and included in a refrigeration cycle via a cooling medium pipe 228 are the compressor 205, the utilization side heat-exchanger 231, and the heat source side heat-exchanger 225.

Upon the air conditioner in this zone being operated, the driving source 219, the air fan 217, the heat source side air fan 240 and the compressor 205 are driven.

With the compressor 205 driven, the cooling medium which is compressed by this compressor 205 enters into the heat source side heat-exchanger 225, and condensed to be liquifyed, then it flows into the utilization side heat-exchanger 231 through the reservoir and the expansion valve etc., (not shown) in which it is evaporated, and returns back to the compressor 205 through an accumulator (not shown).

When the driving source 219 is driven, the air fan 217 is driven to rotate via the driving shaft 229, and accordingly an air outside the zone 220 is withdrawn into the casing 218 through a fresh air inlet port 223 and forced into the air guide 202.

The air diffused and accelerated simultaneously while it passes through an air duct 215 formed between the upper guide 211 and the lower guide 213, and blown out in a film-like air stream in an inclined downward direction through the blow-out port 216 at the tip and thereof. The air stream impinges against a fixed surface and thereby forming at this instant a cylindrical air zone 220 which is surrounded by this film-like air stream, air guide 202 and the fixed surface 208.

On the other hand, when the heat source side air fan 240 is operated to rotate, an air outside the air zone 220 enters into the machine box 221 through a fresh air inlet port 227, and after it is heated up while passing through the heat source side heat-exchanger 225, it is forced by the heat source side air fan 240 and is discharged into an atmosphere through an exhaust port 226.

As the air fan 217 rotates, the air inside the air zone 220 enters into the machine box 210 through an air inlet port 230, and after it is cooled while passing through the utilization side heat-exchanger 231, the is forced by the utilization side sir fan 224 and blown out into the air zone 220 through a conditioning air blow-out port 235 to cool down the interior of the air zone 220.

In the meantime, the above description relates to the case in which the air is utilized to cool down the air zone 220, it is also possible to heat up the air zone 220 by circulating the cooling-medium in the opposite direction in a cooling medium circuit reversing the above cycle.

While specific embodiments of the invention have been shown and described in detail to illustrate the application of the principles of the invention, it will be understood that the invention may be embodied otherwise without departing from such principles.

We claim:

1. An apparatus for conditioning a first zone of fluid and substantially isolating the first zone from a surrounding second zone, the apparatus comprising:

fluid regulating means positioned at a first end of the first zone and for conditioning fluid contained in the first zone, said fluid regulating means circulating the first zone fluid through said fluid regulating means and substantially throughout the first zone;

a jet-stream generating means for generating a stream of fluid at a second end of the first zone;

a guide member positioned at the second end of the first zone and downstream of said jet-stream generating means, said guide members having a guide surface means for substantially guiding said stream of fluid into a canopy-like film layer, said canopy-like film layer initially guided in a radially outward direction and radially beyond said guide surface means, said guide surface means also for guiding said canopy-like film layer in an axial direction, said canopy-like film layer and said guide member defining and isolating the first zone of conditioned fluid from the surround second zone of fluid, the zone being defined by said stream of fluid being guided into said canopy-like film layer, said zone having a diameter larger than said guide member.

2. The apparatus according to claim 1, wherein said guide member and said jet-steam generating means are integrated and supported in a fluid by means of a strut.

3. The apparatus according to claim 1, wherein said guide member and said jet-stream generating means are integrated and suspended in the fluid.

4. The apparatus according to claim 1, wherein said jet-stream generating means is arranged outside said guide members and said guide member is formed in a foldable construction.

5. The apparatus according to claim 1, wherein said fluid regulating means is arranged on a fixed surface in a lower portion of said air zone, and said jet-stream generation means is attached to an upper portion of a strut, said strut being upstandably provided on said fluid regulating means, and said jet-stream generating means is provided with an guide.

6. The apparatus according to claim 5, wherein:

a driving source is contained in said fluid regulation means,;

said strut is hollow; and said driving source and an air fan of said jet-stream generating means are coupled together through a driving shaft which extends through said strut.

7. The apparatus according to claim 1, wherein a heat source unit is arranged outside said first zone, and a heat source side air fan and a heat source side heat-exchanger are arranged in said heat source unit, and wherein while said heat source side air fan withdraws air from outside said first zone, said heat source side heat-exchanger has its heat exchanged with air supplied by said air fan; a utilization side air fan and a utilization side heat-exchanger are arranged in said fluid regulating means, and wherein while said utilization side air fan withdraws air from said first zone, said utilization side heat-exchanger has its heat exchanged with an air supplied by said utilization side air fan, and said utilization side heat-exchanger and said heat source side heat-exchanger are incorporated in a refrigeration cycle via a cooling medium pipe.

8. An apparatus in accordance with claim 1, wherein:

portions of said canopy-like film layer recombine due to negative pressure formed in the first zone by movement of said canopy-like film layer around said first zone.

9. An apparatus in accordance with claim 1, wherein:

said guide surface means has a concave shape; and said jet-stream generating means is positioned in the first zone, said jet-stream generating means withdrawing fluid from the first zone for said generating of said stream of fluid.

10. The apparatus according to claim 9, wherein said fluid regulating means is an air conditioner, and a conditioning unit thereof is arranged outside the first zone.

11. The apparatus according to claim 10, wherein said air conditioner has conditioning air blow-out ports arranged on a circumference thereof.

12. The apparatus according to claim 10, wherein said air conditioner has an upper portion with a table.

13. An apparatus in accordance with claim 1, wherein:

said guide surface means has a convex shape; and said jet-stream generating means is positioned outside the first zone, said jet-stream generating means withdrawing fluid from the second zone for said generating of said stream of fluid.

14. An apparatus in accordance with claim 1, further comprising:

a plurality of first zones separated from each other and each of said plurality of first zones being isolated and surrounded by the second zone, said each of said plurality of first zones including a corresponding fluid regulating means, jet-stream generating means, guide member and guide surface means.

15. An apparatus in accordance with claim 1, further comprising:

a fixed wall positioned at said first end of said first zone, said canopy-like film layer impinging against said fixed wall.

16. An apparatus in accordance with claim 15, wherein:

portions of said canopy-like film layer flow outward from said first zone along said fixed wall.

17. An apparatus in accordance with claim 4, wherein:

said guide member is foldable in the manner of a parasol.

* * * * *